United States Patent [19]

Abbott

[11] 4,360,077

[45] Nov. 23, 1982

[54] AERIAL LIFT PLATFORM APPARATUS WITH CONTROL CONDUIT SUPPORT SYSTEM

[75] Inventor: Thomas C. Abbott, McConnellsburg, Pa.

[73] Assignee: JLG Industries, McConnellsburg, Pa.

[21] Appl. No.: 165,626

[22] Filed: Jul. 2, 1980

[51] Int. Cl.[3] ..... B66F 11/04

[52] U.S. Cl. ..... 182/2

[58] Field of Search ..... 182/2; 52/118; 212/267, 212/268

[56] References Cited

U.S. PATENT DOCUMENTS

| | | | |
|---|---|---|---|
| 3,075,732 | 1/1963 | Lindenmeyer | 248/49 |
| 3,212,604 | 10/1965 | Garnett | 182/2 |
| 3,480,109 | 11/1969 | Eitel | 182/2 |
| 3,776,367 | 12/1973 | Grove | 182/2 |
| 3,809,180 | 5/1974 | Grove | 182/2 |
| 3,827,197 | 8/1974 | Adam | 52/29 |
| 4,118,907 | 10/1978 | Small | 52/118 |

*Primary Examiner*—Reinaldo P. Machado
*Attorney, Agent, or Firm*—Irvin A. Lavine

[57] ABSTRACT

An aerial lift platform apparatus comprising an extensible telescopic boom having four sections and a workman's platform with a control console on the fly section. Flexible control conduits, electrical and/or hydraulic, extend from the base section to the control console, carried by fixed and slidable tubes and self-supporting carrier tracks.

13 Claims, 6 Drawing Figures

AERIAL LIFT PLATFORM APPARATUS WITH CONTROL CONDUIT SUPPORT SYSTEM

BACKGROUND OF THE INVENTION

The present apparatus relates to an aerial lift platform apparatus, and more particularly to the support system for control conduits which extend between the inner end of the boom and the aerial lift platform on the outer end of the boom.

Aerial lift platform apparatus are known in which there is provided an extensible boom, which may be positioned at different angles to the vertical, and which have a workman's basket or platform at the outer end of the boom, typically at the outer end of the fly section. On or adjacent the workman's platform there is provided a control console, provided with various control elements which may be manipulated by the workman to control such functions as boom angle, boom extension, the rotation of the boom on a vertical axis, and where the aerial lift platform apparatus is of the self-propelled type, there are also provided engine, steering and braking controls. Flexible control conduits have been provided, extending between the control console and the inner or rearward end of the boom, from which they extend to various controlled elements in known manner. These flexible control conduits may include hydraulic hoses and/or electrical cables.

In order to prevent the flexible control conduits from becoming entangled or snarled during extension and retraction of the boom, it has been known to utilize a self-supporting carrier track: see Grove U.S. Pat. Nos. 3,776,367 and Eitel et. al. 3,480,109. These known constructions, which have proven to be satisfactory, were utilized, however, only in connection with telescopic booms of three sections, and of a length sufficient to give a height of the floor of the workman's platform of approximately eighty feet above the ground. Where booms of greater lengths, and therefore greater platform height are required, there have been other systems utilized for supporting the control conduits. See, for example, Garnett U.S. Pat. No. 3,212,604.

The prior art has not disclosed the utilization of the facile self-supporting carrier track on booms of such great length so as to give a platform height of 110 feet. The utilization of a single carrier track, it has been discovered, would not be satisfactory.

SUMMARY OF THE INVENTION

The present invention comprises an aerial lift platform apparatus having a boom of relatively great length, being a four section telescopic boom which includes base, inner mid, outer mid and fly sections, with a workman's platform supported at the outer end of the boom, on the fly section. A control console is provided at the workman's platform, and flexible control conduits are connected to the control console and extend between it and the inner end of the base section. The flexible control conduits, which are hydraulic hoses and/or electrical cables, extend into a first tube which is fixed to one side of the base section, at its inner end. The control conduits exit the outer end of this fixed tube, pass in a bight and enter a first end of a self-supporting carrier track which extends first rearwardly, then in a bight, and then forwardly to a second end. The second end of the self-supporting carrier track is secured to the rear end of a movable tube, the forward end of which is connected to the inner mid section adjacent its outer end, the control conduits passing through the carrier track and through the movable tube, exiting from the movable tube at its forward or outer ends. These control conduits then extend over the top of the inner mid section, near its outer end, and enter a first end of a second carrier track, the second carrier track being located on the opposite side of the boom, and having a first portion extending rearwardly from the first end, then a bight, and then a second portion extending to the second end, which is located at a level above the first end. The second end is connected to the rear end of a movable tube which has its forward end attached to the forward end or outer end of the fly section. The control conduits extend through the second carrier track from the first mentioned end to the second mentioned end thereof, and thence through the movable tube connected to the fly section, exiting the tube and being connected to the control console in known fashion.

Among the objects of the present invention are to provide an aerial lift platform apparatus of comparatively long extended boom length, and having control conduits extending from the boom inner end to a control console on the workman's platform, and having provision to avoid tangling of or damage to the control conduits. A further object is to provide such an apparatus which will be both economical and reliable in operation.

DESCRIPTION OF THE PREFERRED EMBODIMENT

Figure 1:
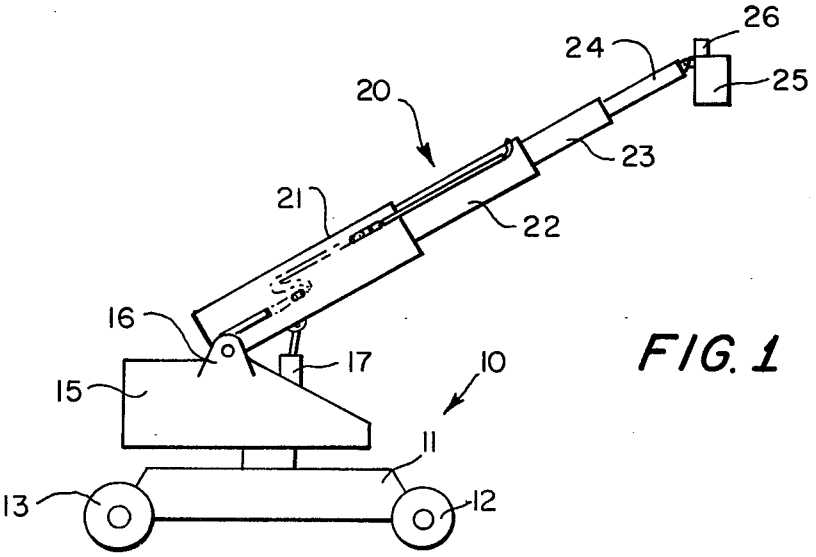
FIG. 1 is an elevational view of an aerial lift platform apparatus having flexible control conduits and a support system therefor in accordance with the present invention.

Referring now to the drawings, wherein like or corresponding reference numerals are used to designate like or corresponding parts throughout the several views, there is shown in FIG. 1 an aerial lift platform apparatus generally designated 10, and including a vehicle body 11 and ground support wheels 12 and 13, which are driven in known fashion, the wheels 12 being steering wheels. On the vehicle 11 is mounted a rotatable upper works 15 of known construction, which may be caused to rotate on a vertical axis, there being a prime mover within the upper works 15. Upper works 15 includes a boom support 16 and lift cylinder 17 for luffing the boom so that it may be inclined at selected elevations. The boom 20 is a telescopically extensible boom and has four sections, these being specifically the base section 21, the inner mid section 22, the outer mid section 23 and the fly section 24. At the outer end of the fly section there is provided a workman's platform 25, which includes a control console 26.

Figure 2A:
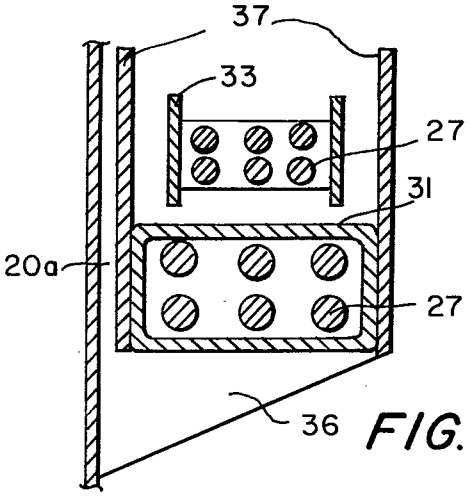
FIG. 2A is a cross-sectional view taken on the line 2A—2A of FIG. 2.
Figure 2:
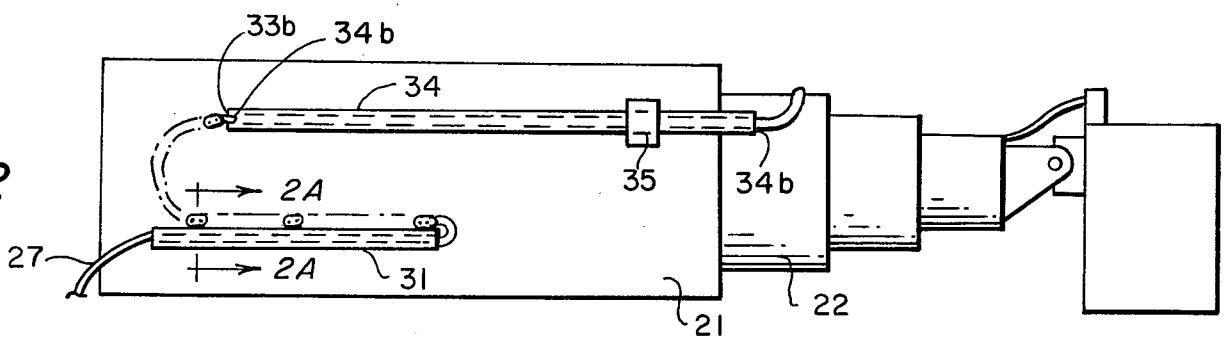
FIG. 2 is an elevational view of the left side of the boom of FIG. 1 in retracted position.

Referring now to FIG. 2, there is shown the left side of the boom 20, as viewed by a workman in the workman's platform 25 and looking towards the base section 21. The left end of base section 21 as shown in FIG. 2 is considered the inner or rear end thereof, and the right end is considered the outer or forward end thereof, and the same designations apply to all of the elements of the boom and the support system.

Flexible control conduits 27 extend from various controlled elements, in conventional manner, and enter a tube 31 which is fixed on the left side of the base section 21, the rear end thereof being adjacent the rear end of the base section, and the forward end thereof extending to approximately the mid point of the base section 21. A self-supporting carrier track 33, which may be of known construction, is connected to the fixed tube 31, and is supported, in part, thereon. More particularly the carrier track 33 has a first end 33*a* which is connected by suitable means adjacent the forward end of the tube 21. The carrier track extends rearwardly from the first end 33*a* thereof, and thence in a bight, and thence extends forwardly so that its second end 33*b* is at a level above the first end 33*a*. The end 33*b* of the carrier track 33 is connected to the inner or rear end 34*a* of a movable tube 34, the forward end 34*b* of which is attached to the inner mid section 22 adjacent the outer end thereof. A bracket 35 is attached to the base section 21 to support the tube 34 as the boom is extended and retracted.

Referring now to FIG. 2A, there is shown a portion of the side wall 20*a* of the base section 20, to which is connected a bracket 36, the tube 31 being secured to it. Within the tube 31 there are shown the control conduits 27, the number thereof being illustrative, only. Connected to the tube 27 are a pair of guide walls 37, shown removed in FIG. 2 for clarity, with the carrier track 33 therein, and carrying and supporting the control conduits 27.

Figure 3:
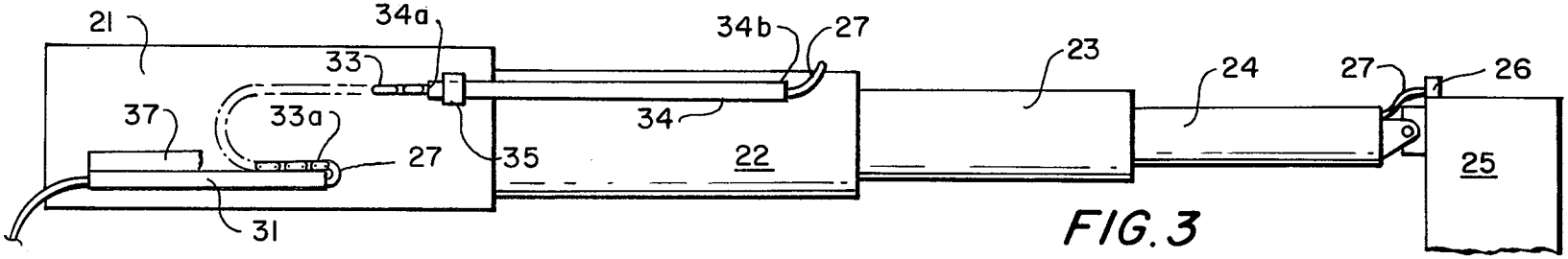
FIG. 3 is a view of the left side of the boom of FIG. 1, in extended condition.

Referring now to FIG. 3, which shows the boom 20 in extended position, the control conduits 27 will be seen to have entered the carrier track 33 at the end 33*a* thereof, then carried by and passed through the carrier track, and then entered the movable tube 34 at the end 34*a* thereof. The conduits 27 then exit the movable tube 34 at the outer or forward end 34*b*, and extend up the side of the inner mid section 22, and then pass transversely of the axis of boom 20, across the top of the inner mid section 22.

Figure 4:
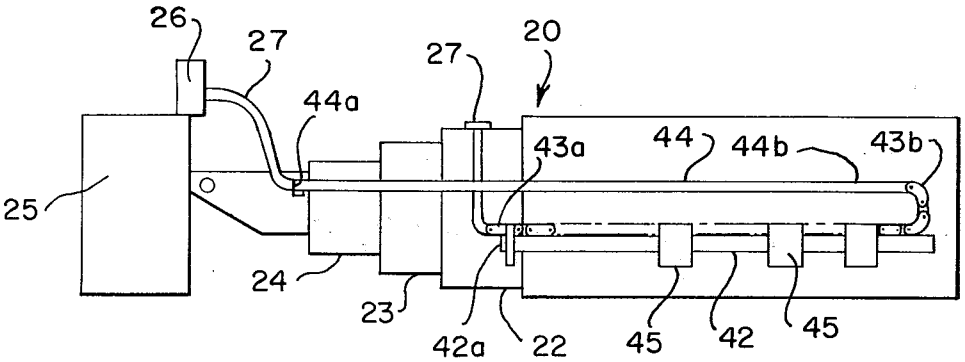
FIG. 4 is an elevational view of the right side of the boom of FIG. 1 in retracted position.

Referring now to FIG. 4, there is shown the opposite, or right, side of the boom 20. Shown thereon is a second self-supporting carrier track 43 having a first end 43*a*, the carrier track 43 extending rearwardly therefrom and then in a bight, and then forwardly, to a second end 43*b* thereof, located at a level above the first end 43*a*. A movable tube 44 is provided, having its forward end 44*a* connected to the forward end of the fly section 24 and having the end 43*b* of the second track 43 connected to the rear end 44*b* thereof.

To support the second carrier track 43 there is provided a linearly extending movable support in the form of a tube 42 which is attached at its forward end 42*a* to the inner mid section 22, near its outer end. Suitable brackets 45 slidably support the movable tube 42, these being attached to the side wall of the base section 21, and support the tube 42 for sliding movement therein. Shown in FIG. 5, partially broken away, is a guide wall 47 extending upwardly from the tube 42, which serves to retain the second carrier track 43, during retraction and extension of the boom 20.

The control conduits 27 may be seen in FIG. 4 extending transversely across the top of the inner mid section 22, and then downwardly along the right side of mid section 22, where they then enter the end 43*a* of the carrier track 43. The control conduits then extend through carrier track 43, and exit it at the end 43*b* thereof, then entering the tube 44 at the end 44*b*, extending through the tube 44, and exiting therefrom at the outer or forward end 44*a*. The control conduits 27 are then connected to the control console 26 on the workman's platform 25.

Figure 5:
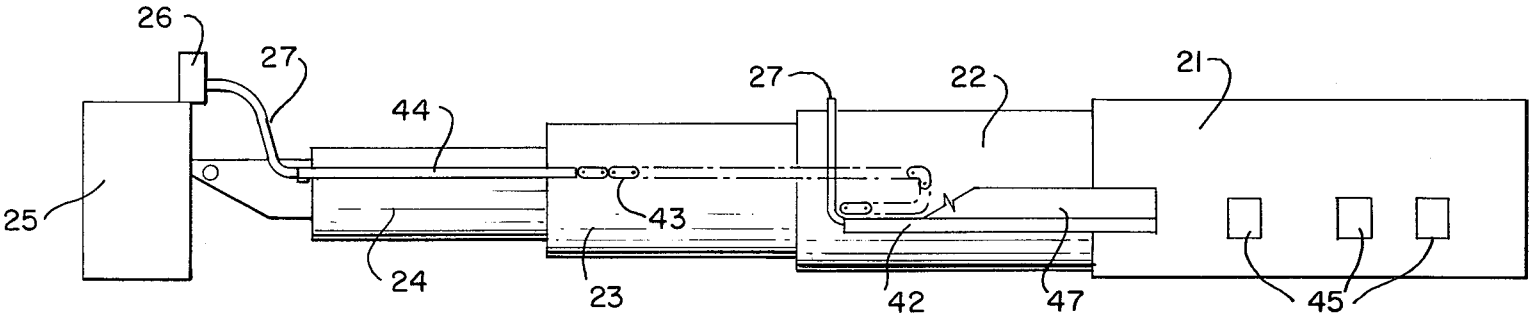
FIG. 5 is an elevational view of the right side of the boom of FIG. 1 in extended position.

FIG. 5 shows the boom 20 in its extended condition, with the carrier tube 42 extending approximately the full length of the inner mid section 22, and with the tube 44 extending approximately the full length of the fly section 24.

There has been provided an aerial lift platform apparatus having a four section boom, which is telescopic, and which is capable of extension to a height of approximately 110 feet from the bottom of the workman's platform to the ground, together with a support system for flexible control conduits which extend from the inner or rearward end of the base section of the boom to a control console on the workman's platform. The control conduits are supported in a manner to prevent entanglements, abrasion and wear, and interference of the working of the boom, by a support system including a pair of carrier tracks, one located on each side of the boom, and both tracks being suitably supported against sagging and interference.

It will be obvious to those skilled in the art that various changes may be made without departing from the spirit of the invention, and therefore the invention is not limited to what is shown in the drawings and described in the specification but only as indicated in the appended claims.

I claim:

1. An aerial lift platform apparatus comprising:

an extensible, four section telescopic boom including base, inner mid, outer mid and fly sections, a workman's platform supported at the outer end of the boom on the fly section, a control console at the workman's platform for controlling said apparatus, flexible control conduits connected to said control console and extending between said control console and the inner end of the base section, and means for supporting said flexible control conduits comprising;

a tube fixed on a side of the base section, a movable tube having its forward end secured to the outer end of the inner mid section and extending rearwardly therefrom, a self-supporting carrier track having one end adjacent the forward end of said fixed tube, extending first rearwardly therefrom and thence through a bight and then forwardly, and having the other end connected to the rear of said movable tube, a second self-supporting carrier track having a first end, said track extending rearwardly therefrom and then in a bight and then forwardly to the second end, a movable tube having its forward end connected to the forward end of the fly section and having the second end of the second track connected to the rear end thereof, and linear support means for said second track extending rearwardly from said first end of said second track and having the forward end thereof connected at the forward end of the inner mid section, said control conduits extending through said tube fixed on the base section, the first track, the first mentioned movable tube, the second track, and the tube fixed to the fly section.

2. The apparatus of claim 1, said tube fixed on the base section, said first mentioned movable tube and said first mentioned track being on one side of said boom, and the second mentioned track, the support means therefor, and the second movable tube being on the other side of said boom.

3. The apparatus of claim 2, said control conduits extending from the end of the first mentioned movable tube transversely of the boom to the first end of the second track.

4. The apparatus of claim 3, said base section on the side thereof with said linear support means having brackets for receiving and supporting said linear support means in the retracted position of said boom.

5. The apparatus of claim 1, wherein the first mentioned track rests in part on said first mentioned fixed tube.

6. The apparatus of claim 5, wherein said first mentioned fixed tube has its inner end adjacent the inner end of the base section and its outer end at approximately the mid point of said base section.

7. The apparatus of claim 1, said first mentioned movable tube extending approximately the length of a boom section.

8. The apparatus of claim 1, said second mentioned movable tube extending approximately the length of a boom section.

9. An aerial lift platform apparatus comprising:

an extensible, four section telescopic boom including base, inner mid, outer mid and fly sections, a workman's platform supported at the outer end of the boom on the fly section, a control console at the workman's platform for controlling said apparatus, flexible control conduits connected to said control console and extending between said control console and the inner end of the base section, and means for supporting said flexible control conduits comprising;

a movable tube having its forward end connected to the forward end of the fly section and extending rearwardly therefrom, a self-supporting carrier track having a first end connected to the rear end of the movable tube, said track having a bight and having a second end below and rearwardly of the first end, support means for the portion of the track between said second end and said bight in all positions of said boom, means for attaching said track second end to said support means, means for attaching said support means to the outer end of the inner mid section, and said control conduits extending through said track and through said movable tube and connected to said control console.

10. The apparatus of claim 9, and means for supporting said control conduits between the outer end of said inner mid section and the inner end of said base section.

11. The apparatus of claim 10, said last mentioned means comprising a tube fixed on a side of the base section, a movable tube having its forward end secured to the outer end of the inner mid section and extending rearwardly therefrom, and a self-supporting carrier track having one end adjacent the forward end of said fixed tube, extending first rearwardly therefrom and thence through a bight and then forwardly, and having the other end connected to the rear of said movable tube.

12. The apparatus of claim 11, said tube fixed on the base section, said second mentioned movable tube and said second mentioned track being on one side of said boom, and the first mentioned track, the support means therefor, and the first movable tube being on the other side of said boom.

13. The apparatus of claim 12, said control conduits extending from the end of the second mentioned movable tube transversely of the boom to the second end of the first track.

* * * * *